US007028653B2

(12) United States Patent
Jesel

(10) Patent No.: US 7,028,653 B2
(45) Date of Patent: Apr. 18, 2006

(54) ROLLER ROCKER MOUNTING MECHANISM

(76) Inventor: Daniel H. Jesel, 1985 Cedar Bridge Ave., Lakewood, NJ (US) 08701

( * ) Notice: Subject to any disclaimer, the term of this patent is extended or adjusted under 35 U.S.C. 154(b) by 129 days.

(21) Appl. No.: 10/403,502

(22) Filed: Apr. 1, 2003

(65) Prior Publication Data

US 2004/0040526 A1 Mar. 4, 2004

Related U.S. Application Data

(60) Provisional application No. 60/368,535, filed on Apr. 1, 2002.

(51) Int. Cl.
*F01L 1/18* (2006.01)

(52) U.S. Cl. ..... 123/90.39; 123/90.4; 123/90.42; 123/90.44; 123/193.3; 29/888.061; 29/888.2; 29/DIG. 37

(58) Field of Classification Search ..... 123/90.42, 123/193.3
See application file for complete search history.

(56) References Cited

U.S. PATENT DOCUMENTS

| | | | | |
|---|---|---|---|---|
| 1,877,051 | A * | 9/1932 | Read | 123/41.82 R |
| 3,401,678 | A * | 9/1968 | Rose | 123/90.42 |
| 4,517,935 | A * | 5/1985 | Pomfret | 123/90.4 |
| 4,856,467 | A * | 8/1989 | Kronich | 123/90.43 |
| 6,178,937 | B1 * | 1/2001 | Solomon et al. | 123/90.41 |
| 6,484,683 | B1 * | 11/2002 | Zielke | 123/193.5 |

* cited by examiner

*Primary Examiner*—Thomas Denion
*Assistant Examiner*—Kyle M. Riddle
(74) *Attorney, Agent, or Firm*—Harbin King & Klima

(57) ABSTRACT

A roller rocker mounting mechanism for an internal combustion engine valve actuating mechanism includes a first rocker stand having a first locating boss and a second rocker stand having a second locating boss. An indexing link has a first portion separably attachable to the first locating boss and a second portion separably attachable to the second locating boss to connect the first rocker stand and the second rocker stand in a manner that prevents rotation of either rocker stand when the rocker stands are attached to the cylinder head.

30 Claims, 6 Drawing Sheets

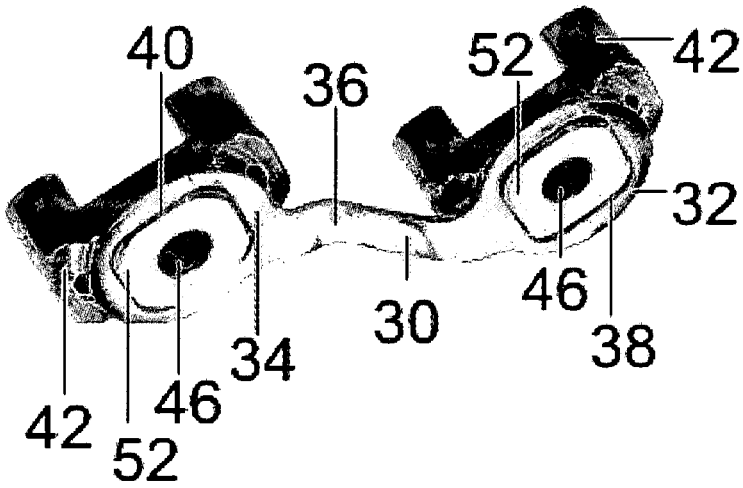
Fig. 4
Fig. 7
(Prior Art)
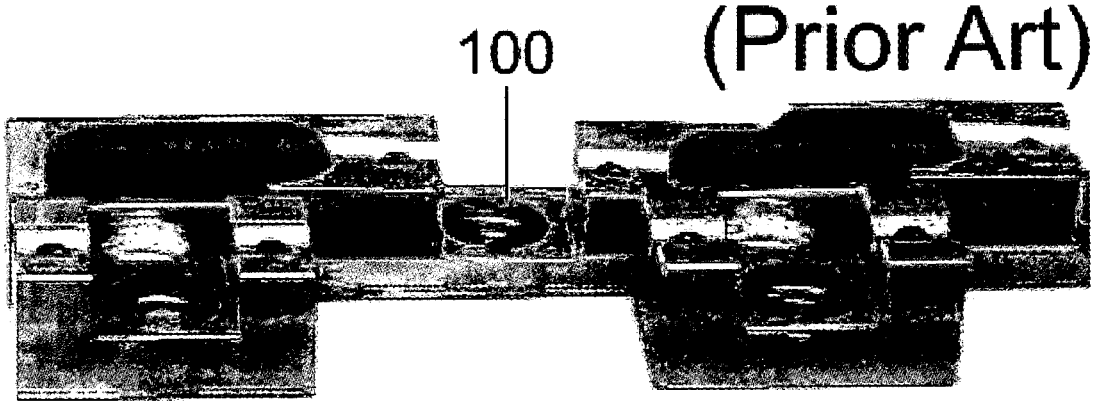
Fig. 8
(Prior Art)
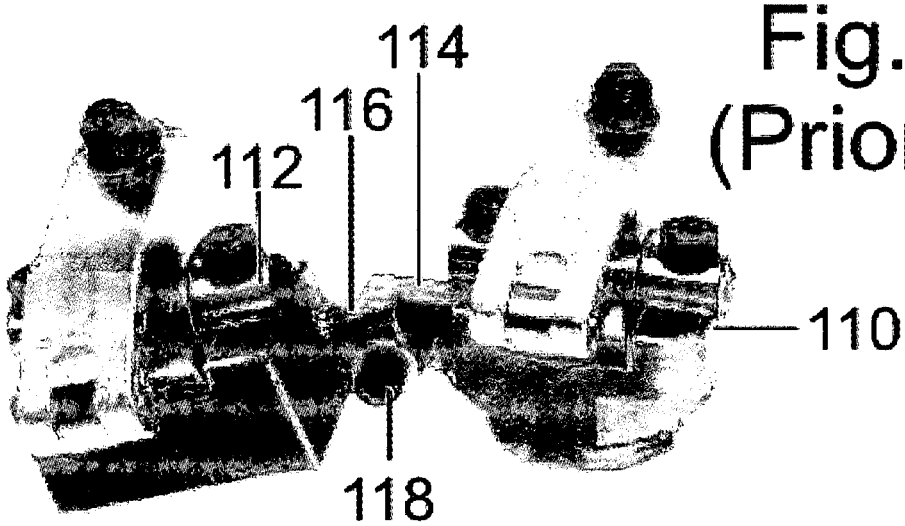

ROLLER ROCKER MOUNTING MECHANISM

This application claims priority to U.S. Patent Application No. 60/368,535, to Daniel Jesel, filed Apr. 1, 2002, entitled Roller Rocker Mounting Mechanism, which application is incorporated by reference herein.

BACKGROUND OF THE INVENTION

The present invention relates to internal combustion engine overhead valve rocker mechanisms.

In certain pushrod type overhead valve engines, such as the Chevrolet® big block, the rocker arms will be attached to the head by a simple stud mechanism screwed into the head. The rocker stud will maintain the rocker in the desired position and allow the rocker to rock about the stud in response to movement from the attached pushrod to actuate the respective valve. However, the rocker stud cannot effectively prevent the rocker from rotating about a longitudinal axis of the rocker stud. Therefore, to prevent such rotation and the resulting misalignment of the rocker with the valve stem, pushrod guides are used in the engine to generally fix the positioning of the pushrods. The pushrods are allowed to move up and down in response to rotation of the camshaft but are prevented from substantial side-to-side movement. This general fixing of the pushrods by the pushrod guides helps prevent rotation of the rockers about the rocker studs.

High performance versions of such engines will often use roller rocker arms. A rocker stand is mounted to the head, usually by bolting the stand to the same threaded bores as the rocker studs use. The rocker stand supports a shaft mounted transversely to the rocker stand mounting bolt and the roller rocker arms are mounted by roller bearings on the shaft. This roller bearing mounting of the rocker arm is more efficient and can better withstand higher actuating forces found in high performance engines than can a standard rocker arm. Since the rocker stands are mounted to the head by the single bolt, they are subject to rotation about the bolt. The shaft is usually fixed to the rocker stand at both ends and so the roller rocker arm will also rotate with the rocker stand about the mounting bolt. Therefore, some provision must be made to prevent rotation of each rocker stand and respective roller rocker.

One approach to preventing rotation of the rocker stands has been to mount several roller rockers on an extended rocker stand. However, such rocker stands are complex, expensive to manufacture and not easily set up. Also, substantial machining of the cylinder head is required to accommodate such stands. See FIG. 7 (Prior Art) which shows a portion of such a known multiple rocker stand which supports four roller rockers, two of which are needed for each big block cylinder head.

Another approach has been to bolt adjacent rocker arms together to prevent rotation. See FIG. 8 (Prior Art) which shows such a known pair of rocker assemblies 110 and 112. Each of the rocker assemblies 110 and 112 include a tab 114 and 116, respectively, which can be bolted together by bolt 118 to prevent rotation of the rocker stands. While this method is effective in preventing rotation of the rocker roller, it is also expensive as it requires different intake and exhaust rocker stands. Further, because of the canting of the rocker stands, if tight tolerances are not maintained, or the rocker stands are shimmed at all, the geometry of the two rocker stands with respect to each other can change enough such that the bolt 118 cannot be passed through one or both of the tabs to allow the rocker stands to be bolted together.

This may then require further expensive and time-consuming machining of the rocker stands and/or cylinder head to provide the desired dimensions and tolerances.

In addition, it has been found that many aftermarket cylinder heads are not machined to the proper dimensions. When roller rocker components having correct dimensions are installed on such cylinder heads, the components may not have the correct geometry to operate properly. Although the roller rocker components are correct and it is the cylinder head that is incorrect, the purchaser tends to assume the opposite, leading to poor customer relations that are unjustified for the supplier of the roller rocker components.

Therefore, a simple, cost effective mechanism is needed for mounting rocker roller arms to a cylinder head while preventing rotation of the rocker roller arms about a rocker stand mounting bolt. Such a mechanism should be able to operate properly even when the dimensions of the cylinder head are beyond design tolerances.

SUMMARY OF THE INVENTION

The present invention is a roller rocker mounting mechanism for mounting a roller rocker to a cylinder head. It includes an indexing link for accurately positioning and aligning a pair of identical rocker stands on adjacent rocker mounting bosses, allowing independent height adjustment of each rocker stand while preventing rotation of the rocker stands and the respective roller rockers. The mechanism is compact, simple and inexpensive to manufacture and allows a single rocker stand to be used for both intake and exhaust valves, as well as for various valve height configurations. This reduces the need for numerous rocker stand configurations of more complex and expensive configurations.

It is a specific object of the present invention to provide a roller rocker mounting mechanism that prevents rotation of the rocker stand and roller rocker about mounting bolt axis.

It is a further object of the present invention to provide a roller rocker mounting mechanism that utilizes and anti-rotationally connects a pair of identical or substantially identical rocker stands.

It is a further object of the present invention to provide a roller rocker mounting mechanism that provides a simple, manual and independent height adjustment of each rocker stand of the mechanism by the engine assembler without requiring machining of any components.

It is a further object of the present invention to provide a roller rocker mounting mechanism that allows a pair of separate rocker stands to be accurately aligned with one another.

It is a further object of the present invention to provide a roller rocker mounting mechanism that allows use of a single configuration of rocker stand to be used for both intake and exhaust valves of an engine, as well as for different valve height configurations in the same or different engine(s).

It is a further object of the present invention to provide a roller rocker mounting mechanism that can be used in different engine configurations by the simple change of an indexing link tying together two or more rocker stands.

It is a further object of the present invention to provide a roller rocker mounting mechanism that is compact, simple and inexpensive to manufacture.

It is a further object of the present invention to provide a roller rocker mounting mechanism that reduces the number of total components required to apply the mechanism to a variety of different engines.

The invention is more fully described in combination with the accompanying drawings, in which, like reference numerals indicate like components.

BRIEF DESCRIPTION OF THE DRAWINGS

FIG. 4 shows a bottom perspective view of a pair of rocker stands engaged with the indexing link;

FIG. 7 (Prior Art) is a partial perspective view of a known multiple roller rocker stand; and FIG. 8 (Prior Art) is a perspective view of a known pair of roller rocker stands.

DETAILED DESCRIPTION OF THE INVENTION

Figure 1:
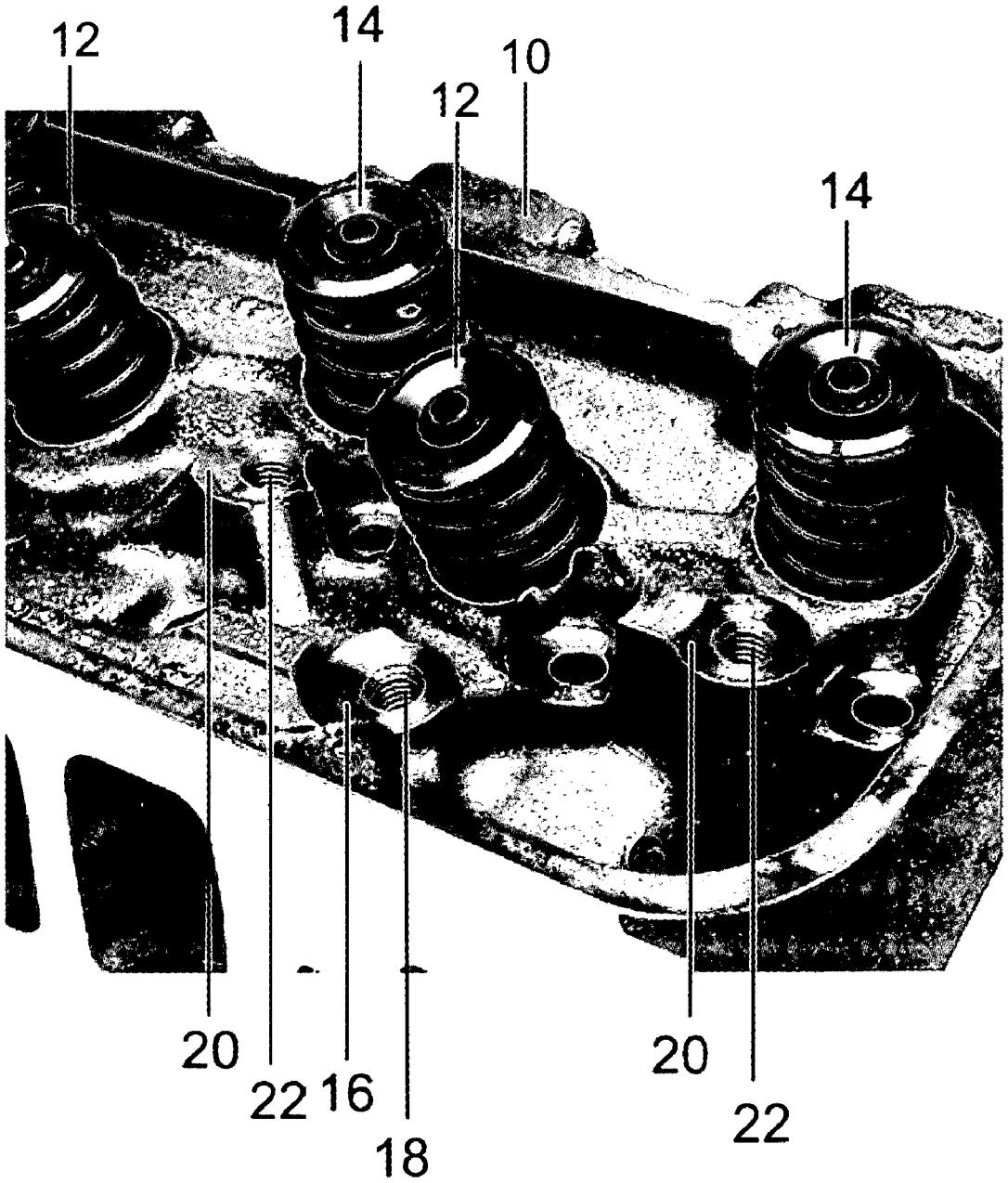
FIG. 1 (Prior Art)
FIG. 1 (Prior Art) is a partial perspective view of a Chevrolet® big block cylinder head.

FIG. 1 (Prior Art) shows a portion of a Chevrolet® big block cylinder head 10 with a plurality of intake valve assemblies 12 and exhaust valve assemblies 14 installed. As can be seen, the intake valves 12 are canted with respect to the exhaust valves 14. A plurality of mounting bosses 16 are provided, each having a threaded bore 18 for mounting the intake rocker arms to the cylinder head 10. In a conventional head with non-roller rocker arms, each intake rocker arm would be mounted to its respective mounting boss 16 by a rocker stud threaded into bore 18. Similarly, a plurality of mounting bosses 20 are provided, each having a threaded bore 22 for mounting the exhaust rocker arms to the cylinder head 10. As can be seen, the mounting bosses 16 are relatively lower than the mounting bosses 20, as well as being canted similarly to the canting of the intake valves. This configuration of the cylinder head 10 is known, as are other details, which are not necessary to discuss herein.

Figure 2:
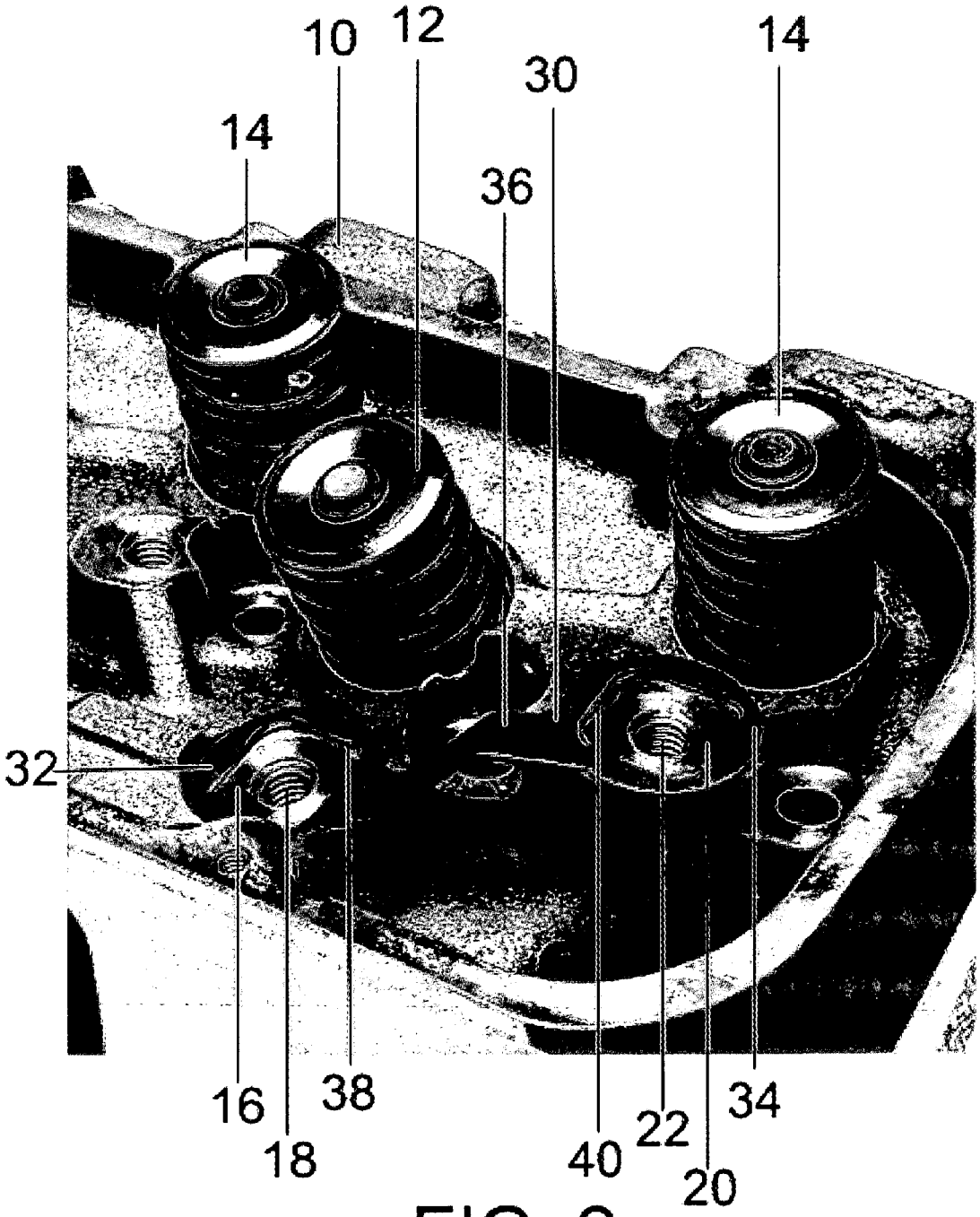
FIG. 2 is a perspective view of an indexing link of the present invention positioned on mounting bosses of the cylinder head of FIG. 1.

FIG. 2 shows a rocker arm indexing link 30 of the present invention positioned on adjacent mounting bosses 16 and 20. The indexing link 30 includes an intake end 32, an exhaust end 34 and an interconnecting bar 36. Each of the ends has a generally circular outer shape to fit well within the conventionally machined areas of the cylinder head 10 forming the respective mounting bosses 16 and 20. In this manner, additional machining of the cylinder head is not required to fit the indexing link 30. The respective ends 32 and 34 include generally square or rectangular locating bores 38 and 40, respectively. The locating bores 38 and 40 can also have other shapes. The use of appropriately aligned asymmetrical shapes for the bores 38 and 40, and the respective locating bosses 52 can help assure correct assembly of the roller rocker mounting mechanism to the cylinder head 10.

In the preferred embodiment, the indexing link 30 is configured as a formed sheet metal stamping having a generally uniform thickness. Such a part is quick and inexpensive to manufacture. The indexing link is configured so that the intake end 32 and exhaust end 34 are canted and offset as to height the same as the mounting bosses 16 and 20 so that intake end 32 and exhaust end 34 position accurately and flatly over the respective mounting bosses 16 and 20 with axes of the locating bores 38 and 40 generally coincident with axes of the threaded bores 18 and 22, respectively. However, it is not required that axes of the locating bores 38 and 40 be coincident with the axes of the threaded bores 18 and 22. See also FIGS. 6*a–e* which show one embodiment of the indexing link 30 from a number of different perspectives.

Figure 3:
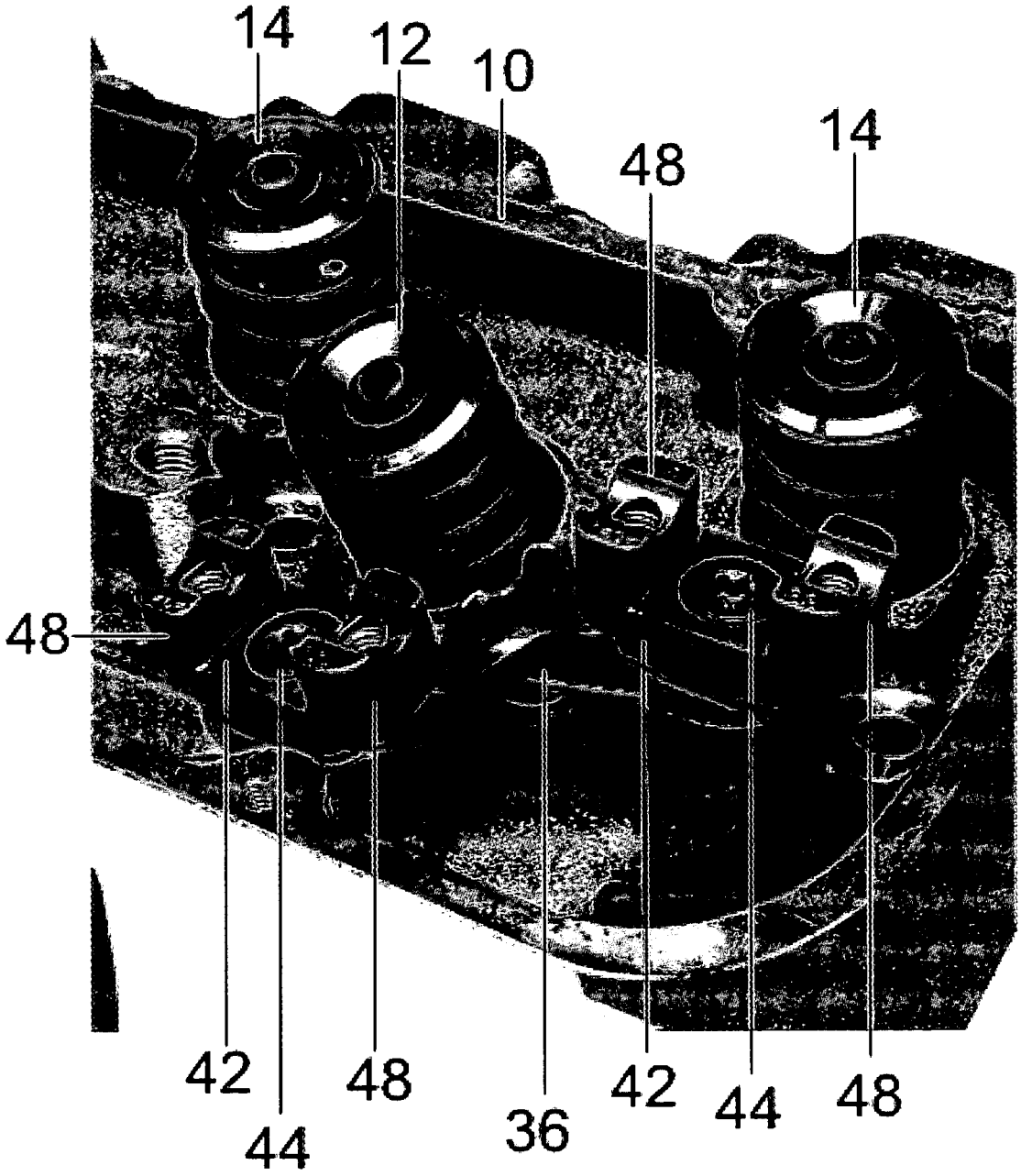
FIG. 3 is a perspective view of a pair of rocker stands of the present invention mounted over the indexing link shown in FIG. 2.

FIG. 3 shows a pair of rocker arm stands 42 mounted to the cylinder head 10 by a pair of mounting bolts 44, engaging the respective threaded bores 18 and 22. In the preferred embodiment, the rocker stands 42 are identical or substantively identical to one another, and so are given the same reference numeral. Each rocker stand 42 includes a central bore 46 for accommodating the mounting bolt 44 and a pair of mounting bosses 48 for engaging and mounting opposite ends of the rocker shaft 50 in a known manner. Each rocker stand 42 has an outwardly extending locating boss 52, which in this embodiment is downwardly extending, i.e., extending toward the engine/cylinder head. The locating bosses 52 has the same general configuration as the locating bores 38 and 40 so as to engage the respective locating bores and be prevented from rotating with respect to the indexing link 30. See FIG. 4, which shows a bottom view of the indexing link 30 with the locating bosses 52 of the two rocker stands 42 positioned in the respective locating bores 38 and 40. The positioning and angle of the locating bores 38 and 40 is set to provide the correct positioning of the rocker stand 42 with respect to the cylinder head 10 when everything is assembled. The tolerances between the locating bosses and respective locating bores are preferably closely set so as to prevent any substantive rotation between the rocker stands 42 and the indexing link 30. The respective locating bosses 52 can also be positioned elsewhere on the rocker stands 42 and the placement and configuration of the indexing link modified to appropriately interconnect the two rocker stands.

In the preferred embodiment, the locating boss 52 of each rocker stand 42 is thicker than the thickness of the indexing link such that the indexing link is capable of axial movement along the locating bosses and does not alter a height of the rocker stand 42 when mounted to the respective mounting boss 16 and 20. This also allows shims to be placed under the rocker stand 42 where necessary to adjust the height of the rocker stand 42 independently of the other rocker stand and without interference from the indexing link 30. The use of appropriately aligned asymmetrical shapes for the bores 38 and 40, and the respective locating bosses 52 can help assure correct assembly of the roller rocker mounting mechanism to the cylinder head 10.

Figure 5:
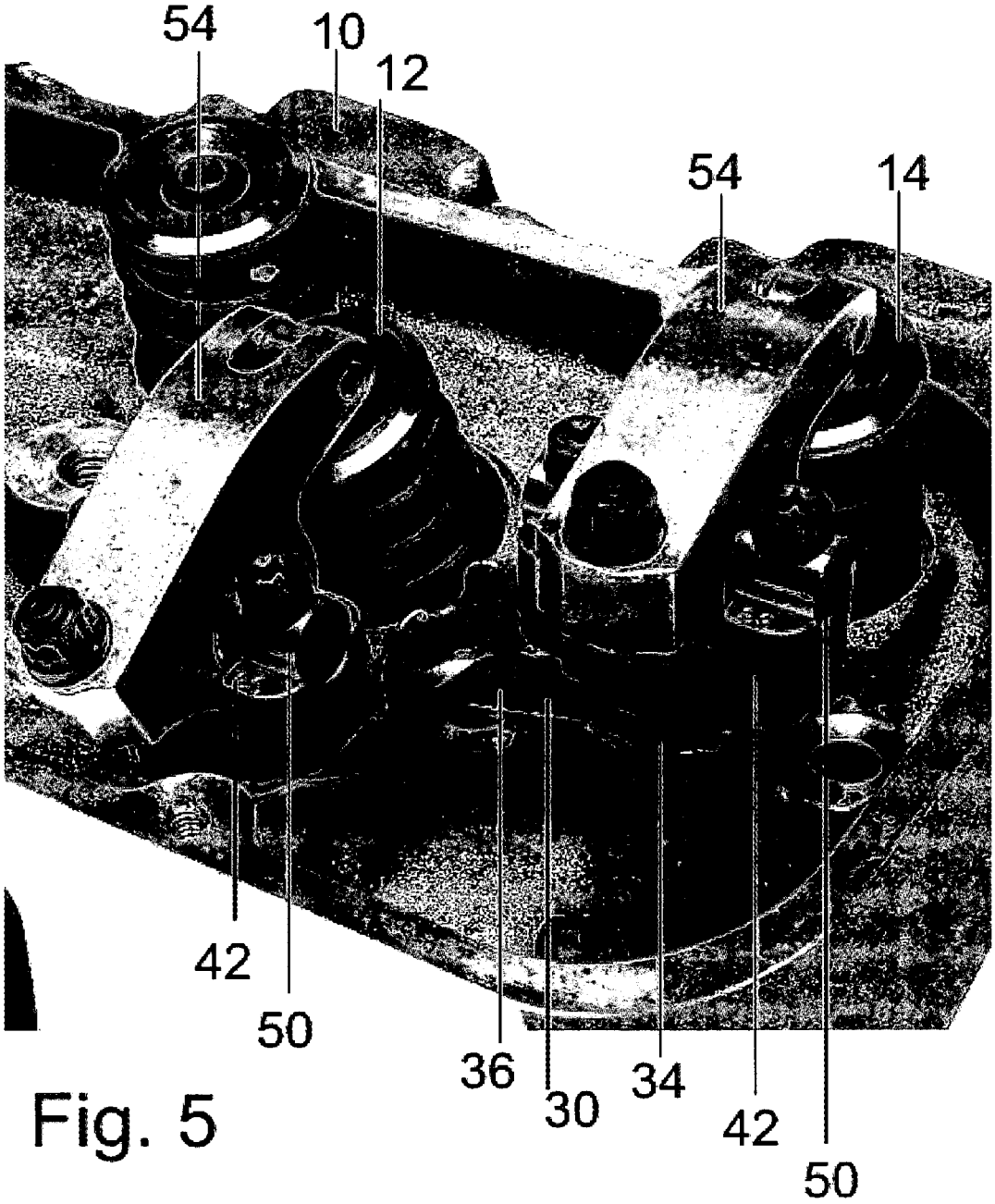
FIG. 5 shows a pair of roller rockers mounted on the rocker stands shown in FIG. 3.
Figure 6D:
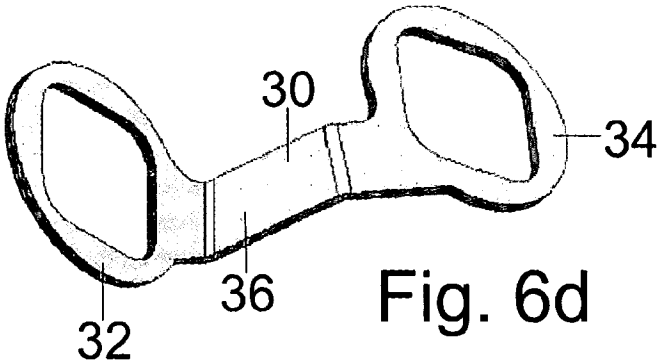
FIGS. 6*a–e* show further views of the indexing link of the present invention.
Figure 6E:
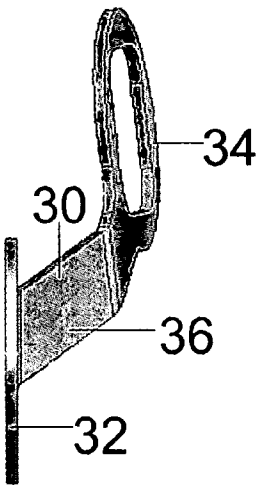
Figure 6A:
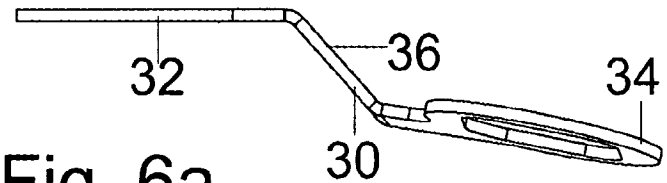
Figure 6B:
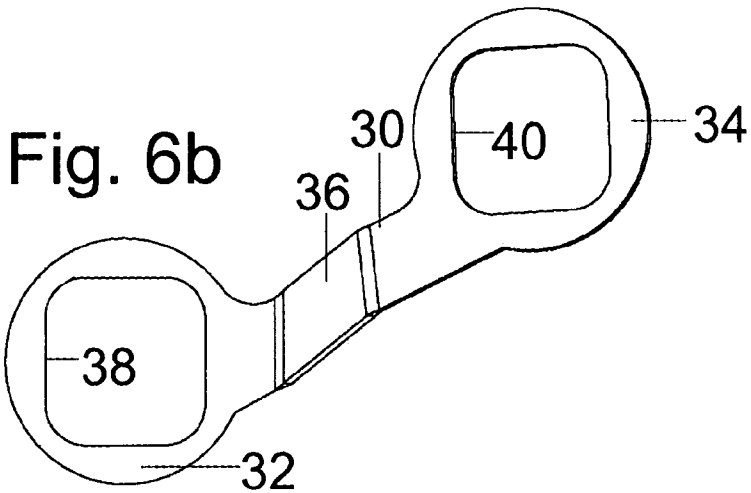
Figure 6C:
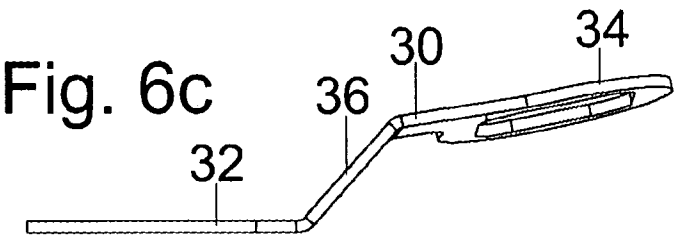

FIG. 5 shows the cylinder head 10 with the rocker stands 42 for a single cylinder mounted and accurately positioned by the indexing link 30. A rocker arm 54 is mounted on each rocker stand 42, ready to actuate its respective valve. The present invention can also be used in engines having 3, 4 or more valves per cylinder.

The present invention allows each rocker stand 42 to be independently adjusted to accommodate various valve heights and desired tolerances with respect to the cylinder head and other components of the valve train while preventing unwanted rotation of the rocker stand. Each rocker stand 42 can be identical and has a compact, relatively simple configuration, reducing inventory and manufacturing costs for different and more complex rocker stands. The indexing link is a simple, inexpensive formed metal stamping. The rocker stands 42 are preferably identical or substantially identical to each other, whether for the intake or exhaust valves, and are preferably machined from steel plate or bar stock. It is also contemplated that differently configured rocker stands can also be used in certain applications and still be aligned and anti-rotationally mounted as discussed above. The present invention can be used with most OEM and aftermarket cylinder heads without additional machining of the cylinder head or time-consuming set-up and can accommodate a range of out-of-tolerance dimensions of the cylinder head without requiring further machining of components. The customer will have fewer problems and will be less likely to unjustly blame the roller rocker components for the problems. The rocker arm stands 42 and indexing link 30 can be dimensioned and configured as necessary to be used on different engines.

While the embodiment shown herein ties together an adjacent intake rocker stand and exhaust rocker stand, the indexing link can be configured where appropriate to tie together adjacent intake rocker arm stands, adjacent exhaust rocker arm stands non-adjacent rocker arm stands or even more than two rocker arm stands, whether intake, exhaust or both, where the construction of the cylinder head assembly would make such a configuration more appropriate. Although only shown with respect to the valve actuating mechanism for one cylinder, the present invention can multiplied as necessary for use with the remaining cylinders of a 2, 4, 6, 8, 10, 12 cylinder engine or an engine with any other number of cylinders.

It is intended that various aspects of the embodiment(s) described above can be combined in different combinations to create different embodiments. Modifications can also be made to such embodiments without departing from the scope of the invention.

What is claimed is:

1. A roller rocker mounting mechanism for an internal combustion engine valve actuating mechanism, comprising:

a first rocker stand separably attachable to a cylinder head of the internal combustion engine for supporting a first valve rocker arm assembly; the first rocker stand including a first locating boss;

a second rocker stand separably attachable to the cylinder head for supporting a second valve rocker arm assembly, the second rocker stand including a second locating boss;

an indexing link; the indexing link having a first portion separably attachable to the first locating boss and a second portion separably attachable to the second locating boss to connect the first rocker stand and the second rocker stand in a manner that prevents rotation of either rocker stand when the rocker stands are attached to the cylinder head.

2. A roller rocker mounting mechanism as in claim 1, wherein the first locating boss has an outwardly extending male configuration and the indexing link first portion includes a correspondingly configured first locating bore, the first locating bore constructed and arranged to receive the first locating boss in a closely toleranced manner that prevents substantive rotation between the first rocker stand and the indexing link about an axis of the first locating bore.

3. A roller rocker mounting mechanism as in claim 2, wherein the second locating boss has an outwardly extending male configuration and the indexing link second portion includes a correspondingly configured second locating bore, the second locating bore constructed and arranged to receive the second locating boss in a closely toleranced manner that prevents substantive rotation between the second rocker stand and the indexing link about an axis of the second locating bore.

4. A roller rocker mounting mechanism as in claim 3, wherein:

the first locating boss extends downwardly from the first rocker stand to engage a first mounting boss of the cylinder head and support the first rocker stand on the cylinder head;

the second locating boss extends downwardly from the second rocker stand to engage a second mounting boss of the cylinder head and support the second rocker stand on the cylinder head; and when the first and second rocker stands are attached to the cylinder head, the indexing link first portion is positioned between a portion of the first rocker stand and the cylinder head, and the indexing link second portion is positioned between a portion of the second rocker stand and the cylinder head.

5. A roller rocker mounting mechanism as in claim 4, wherein the indexing link is configured so that the indexing link first portion flatly engages the cylinder head first mounting boss when the indexing link second portion flatly engages the cylinder head second mounting boss.

6. A roller rocker mounting mechanism as in claim 5, wherein a thickness of the first locating boss is greater than a thickness of the indexing link first portion and a thickness of the second locating boss is greater than a thickness of the indexing link second portion such that the indexing link is capable of axial movement along the locating bosses when the rocker stands are attached to the cylinder head to allow for height adjustment of each rocker stand with respect to the cylinder head independently of the other rocker stand and the indexing link.

7. A roller rocker mounting mechanism as in claim 6, wherein the first rocker stand and the second rocker stand are substantively identical.

8. A roller rocker mounting mechanism as in claim 7, wherein the indexing link is constructed as a flat metal stamping and includes an interconnecting bar that connects the indexing link first and second portions.

9. A roller rocker mounting mechanism as in claim 8, wherein the locating bosses and the locating bores are generally rectangular in shape.

10. A roller rocker mounting mechanism as in claim 9, wherein the cylinder head is of conventional construction and the indexing link first portion and indexing link second portion are configured to fit within respective areas above the first mounting boss and second mounting boss of the cylinder head without additional machining of the cylinder head.

11. A roller rocker mounting mechanism as in claim 10, wherein the first rocker stand is for an intake valve and the second rocker stand is for an exhaust valve.

12. A roller rocker mounting mechanism as in claim 11, wherein the indexing link includes at least one further portion for engaging and connecting to at least one further rocker stand in a manner similar to the connection between the indexing link and one of the first and second rocker stands.

13. A roller rocker mounting mechanism as in claim 4, wherein a thickness of the first locating boss is greater than a thickness of the indexing link first portion and a thickness of the second locating boss is greater than a thickness of the indexing link second portion such that the indexing link is capable of axial movement along the locating bosses when the rocker stands are attached to the cylinder head to allow for height adjustment of each rocker stand with respect to the cylinder head independently of the other rocker stand and the indexing link.

14. A roller rocker mounting mechanism as in claim 4, wherein the first rocker stand and the second rocker stand are substantively identical.

15. A roller rocker mounting mechanism as in claim 1, wherein the first rocker stand and the second rocker stand are substantively identical.

16. A roller rocker mounting mechanism as in claim 4, wherein the indexing link includes at least one further portion for engaging and connecting to at least one further rocker stand in a manner similar to the connection between the indexing link and one of the first and second rocker stands.

17. A valve actuating assembly for an internal combustion engine, comprising:

a cylinder kit comprising:

a first valve rocker arm assembly;

a first rocker stand separably attachable to a cylinder head of the internal combustion engine for supporting the first valve rocker arm assembly; the first rocker stand including a first locating boss;

a second valve rocker arm assembly;

a second rocker stand separably attachable to the cylinder head for supporting the second valve rocker arm assembly, the second rocker stand including a second locating boss;

an indexing link; the indexing link having a first portion separably attachable to the first locating boss and a second portion separably attachable to the second locating boss to connect the first rocker stand and the second rocker stand in a manner that prevents rotation of either rocker stand when the rocker stands are attached to the cylinder head.

18. A roller rocker mounting mechanism as in claim 17, wherein:

the first locating boss has an outwardly extending male configuration and the indexing link first portion includes a correspondingly configured first locating bore, the first locating bore constructed and arranged to receive the first locating boss in a closely toleranced manner that prevents substantive rotation between the first rocker stand and the indexing link about an axis of the first locating bore;

the second locating boss has an outwardly extending male configuration and the indexing link second portion includes a correspondingly configured second locating bore, the second locating bore constructed and arranged to receive the second locating boss in a closely toleranced manner that prevents substantive rotation between the second rocker stand and the indexing link about an axis of the second locating bore;

the first locating boss extends downwardly from the first rocker stand to engage a first mounting boss of the cylinder head and support the first rocker stand on the cylinder head;

the second locating boss extends downwardly from the second rocker stand to engage a second mounting boss of the cylinder head and support the second rocker stand on the cylinder head; and when the first and second rocker stands are attached to the cylinder head, the indexing link first portion is positioned between a portion of the first rocker stand and the cylinder head, and the indexing link second portion is positioned between a portion of the second rocker stand and the cylinder head.

19. A roller rocker mounting mechanism as in claim 18, wherein the indexing link is configured so that the indexing link first portion flatly engages the cylinder head first mounting boss when the indexing link second portion flatly engages the cylinder head second mounting boss.

20. A roller rocker mounting mechanism as in claim 19, wherein a thickness of the first locating boss is greater than a thickness of the indexing link first portion and a thickness of the second locating boss is greater than a thickness of the indexing link second portion such that the indexing link is capable of axial movement along the locating bosses when the rocker stands are attached to the cylinder head to allow for height adjustment of each rocker stand with respect to the cylinder head independently of the other rocker stand and the indexing link.

21. A roller rocker mounting mechanism as in claim 20, wherein the first rocker stand and the second rocker stand are substantively identical.

22. A roller rocker mounting mechanism as in claim 21, wherein the cylinder head is of conventional construction and the indexing link first portion and indexing link second portion are configured to fit within respective areas above the first mounting boss and second mounting boss of the cylinder head without additional machining of the cylinder head.

23. A roller rocker mounting mechanism as in claim 22, wherein the first rocker stand is for an intake valve and the second rocker stand is for an exhaust valve.

24. A roller rocker mounting mechanism as in claim 23, wherein the indexing link includes at least one further portion for engaging and connecting to at least one further rocker stand in a manner similar to the connection between the indexing link and one of the first and second rocker stands.

25. A roller rocker mounting mechanism as in claim 18, wherein a thickness of the first locating boss is greater than a thickness of the indexing link first portion and a thickness of the second locating boss is greater than a thickness of the indexing link second portion such that the indexing link is capable of axial movement along the locating bosses when the rocker stands are attached to the cylinder head to allow for height adjustment of each rocker stand with respect to the cylinder head independently of the other rocker stand and the indexing link.

26. A roller rocker mounting mechanism as in claim 18, wherein the first rocker stand and the second rocker stand are substantively identical.

27. A roller rocker mounting mechanism as in claim 17, wherein the first rocker stand and the second rocker stand are substantively identical.

28. A roller rocker mounting mechanism as in claim 18, wherein the indexing link includes at least one further portion for engaging and connecting to at least one further rocker stand in a manner similar to the connection between the indexing link and one of the first and second rocker stands.

29. A roller rocker mounting mechanism as in claim 17, comprising at least 6 such cylinder kits.

30. A roller rocker mounting mechanism as in claim 17, comprising at least 8 such cylinder kits.

* * * * *